United States Patent [19]

Benson

[11] 3,992,015

[45] Nov. 16, 1976

[54] FOUR-PRONG PUTTER HEAD SUPPORT

[76] Inventor: Glenn S. Benson, 705 N. Studebaker, Mishawaka, Ind. 46544

[22] Filed: Jan. 24, 1975

[21] Appl. No.: 543,829

[52] U.S. Cl. ..... 273/80.2

[51] Int. Cl.[2] ..... A63B 53/02

[58] Field of Search ..... 273/73 G, 77 R, 80 C, 273/80.2–80.8, 163 R, 164, 167–175, 183 D, 193 R, 194 R, 194 A, 162 R; D34/5 GC, 5 GH

[56] References Cited

UNITED STATES PATENTS

| | | | |
|---|---|---|---|
| 687,539 | 11/1901 | Palmer | 273/80.2 |
| 1,116,417 | 11/1914 | Hackbarth | 273/164 X |
| 1,250,296 | 12/1917 | Fitzjohn et al. | 273/167 G X |
| 1,511,479 | 10/1924 | Kelly et al. | 273/168 X |
| 1,652,404 | 12/1927 | Graveure | 273/164 |
| 1,952,624 | 3/1934 | Inman et al. | 273/168 X |
| 2,644,689 | 7/1953 | Putnam | 273/80 C X |
| 3,176,987 | 4/1965 | Johnston | 273/80.2 X |
| 3,675,923 | 7/1972 | Allen et al. | 273/80.2 |
| D188,857 | 9/1960 | Mospan | 273/167 G X |
| D209,301 | 11/1967 | Comitz | 273/80.2 X |
| D209,761 | 1/1968 | Solheim | D34/5 GC |
| D217,873 | 6/1970 | Steele | D34/5 GH |
| D220,844 | 6/1971 | Letters | 273/167 G X |
| D223,031 | 2/1972 | Ernst | 273/80 C X |
| D223,766 | 6/1972 | Houghtaling | 273/167 G X |
| D223,767 | 6/1972 | Houghtaling | 273/167 G X |

FOREIGN PATENTS OR APPLICATIONS

| | | | |
|---|---|---|---|
| 17,228 | 12/1928 | Australia | 273/73 G |
| 1,232,651 | 5/1971 | United Kingdom | 273/80 C |

*Primary Examiner*—Richard J. Apley
*Attorney, Agent, or Firm*—Woodhams, Blanchard and Flynn

[57] ABSTRACT

A golf putter having an elongated head with an upright striking surface and a generally horizontally extending surface extending rearwardly from the upper edge of the striking face. Four prongs are connected to and extend between the horizontally extending surface and a support member. The four prongs are grouped into two groups each containing two prongs. A first prong in each group is connected to the horizontally extending surface at a location spaced rearwardly from the upper edge and the second prong in each group is connected to the horizontally extending surface at a location spaced further rearwardly from the first prong. The first prongs are equally spaced from a theoretical plane perpendicular to the striking face and containing the center of the elongated head. The second prongs in each group are equally spaced from the theoretical plane and from the first prongs. An insert is secured in the opening defined by the horizontally extending surface, the four prongs and support member.

9 Claims, 7 Drawing Figures

FOUR-PRONG PUTTER HEAD SUPPORT

FIELD OF THE INVENTION

This invention relates to a golf putter and, more particularly, to a structure for securing the shaft of the golf putter to the golf putter head.

BACKGROUND OF THE INVENTION

The invention arose out of a need to improve the "feel" of a golf putter during the period of time that the ball is being struck by the putter head. The term feel is a function of the magnitude of the vibrations which are applied to the shaft of the golf putter during the period of time that the golf ball is being struck by the putter head. In addition, it is important that the magnitude of torque applied to the shaft of the golf club be minimized as much as possible when the golf ball is struck by the putter head at a position on the putter head which is off-center from the center of mass thereof.

I have discovered a way to minimize the amount of torque applied to the shaft of the golf club to hold a straighter putting line and, further, a way to improve the feel of the golf club during the period of time that the putter head strikes the golf ball. These improvements result from a balanced and direct transmission of the vibrations from the putter head directly to the golf club shaft.

Accordingly, it is an object of this invention to provide an improved connection between the putter head and the golf club shaft which will minimize torquing during the period of time that the putter head strikes the golf ball by evenly transmitting vibrations from the putter head to the golf club shaft during the period of time that the putter head strikes the golf ball.

It is a further object of this invention to provide an insert between the force transmitting prongs and the putter head to give the appearance of strength and rigidity in the connection between the handle and the putter head and to provide a convenient location for the display of a trademark or the like.

It is a further object of this invention to provide a golf putter which is durable in construction and appealing in appearance.

Other objects and purposes of this invention will be apparent to persons acquainted with golf putters of this general type upon reading the following specification and inspecting the accompanying drawing.

Figure 1:
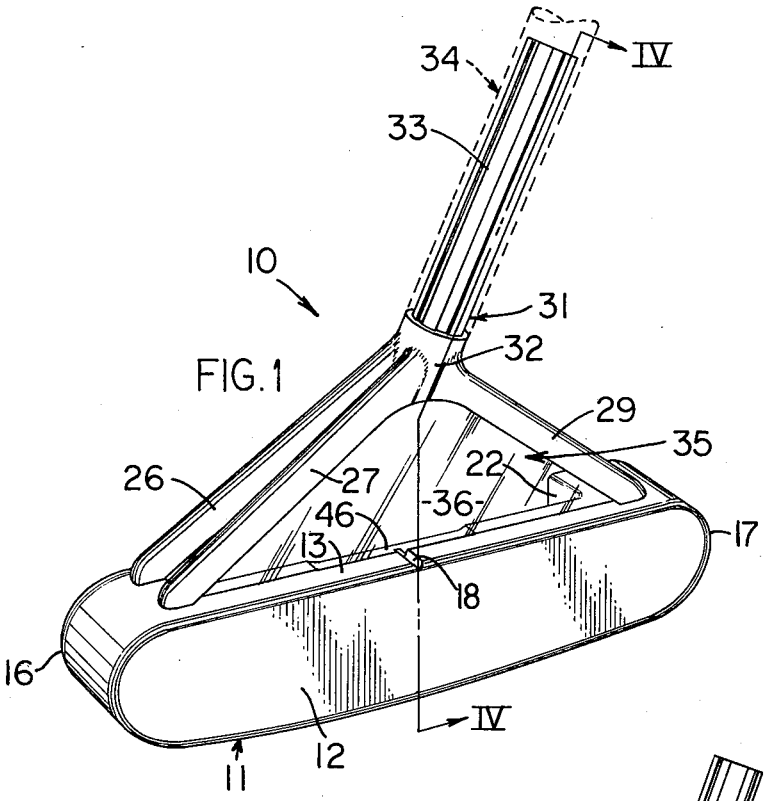
FIG. 1 is a perspective view of a golf putter embodying the invention.

Certain terminology will be used in the following description for convenience in reference only and will not be limiting. The words "up", "down", "right" and "left" will designate directions in the drawing to which reference is made. The words "in" and "out" will refer to directions toward and away from, respectively, the geometric center of the device and designated parts thereof. Such terminology will include the words above specifically mentioned, derivatives thereof and words of similar import.

SUMMARY OF THE INVENTION

In general, the objects and purposes of the invention are met by providing a golf putter having an elongated head with an upright striking face and a generally horizontally extending surface extending rearwardly from the striking face adjacent the upper edge thereof. Four prongs are provided which are connected to the horizontally extending surface and which are grouped into two groups of two prongs. A first prong in each group is connected to the horizontally extending surface at a location spaced rearwardly from the upper edge and a second prong in each group is connected to the horizontally extending surface at a location spaced further rearwardly from the first prong. The first prongs in the two groups are equally spaced from a theoretical plane extending perpendicular to the striking face and containing the center of the elongated head. The second prongs in the two groups are equally spaced from the theoretical plane and from the first prongs. A support is provided which is spaced above the horizontally extending surface and is adapted to be secured to the shaft of a golf club. Each of the four prongs extend between the horizontally extending surface and the support and are connected at their upper ends to the support. An insert is provided in the opening between the prongs and the horizontally extending surface.

DETAILED DESCRIPTION

A golf putter 10 is illustrated in FIG. 1 and is composed of an elongated head 11 having an upright striking face 12 thereon. The striking face 12 extends in a generally vertical plane. The elongated head 11 has a generally horizontally extending upper surface 13 and a generally horizontally extending and slightly arced bottom surface 14. The opposite ends 16 and 17 of the elongated head 11 are rounded so that there is a smooth transition between the horizontally extending upper and lower surfaces 13 and 14, respectively. An elongated groove 18 is provided in the horizontally extending upper surface 13 and extends from the upper edge between the striking face 12 and the horizontally extending surface 13 rearwardly therefrom. The groove 18 extends generally perpendicular to the plane of the striking face 12 and the longitudinal center of the groove 18 is contained in a theoretical plane which contains the longitudinal center of the elongated head 11. A rearwardly opening and upwardly opening recess 19 is provided in the back of the elongated head 11. More specifically, the recess 19 has lateral sidewalls 21 and 22, a bottom wall 23 extending generally parallel to the bottom surface 14 of the elongated head and a back surface 24 which is spaced rearwardly from and extends generally parallel to the striking face 12. The recess 19 minimizes the amount of material utilized in forming the elongated head to thereby minimize the weight thereof.

Figure 3:
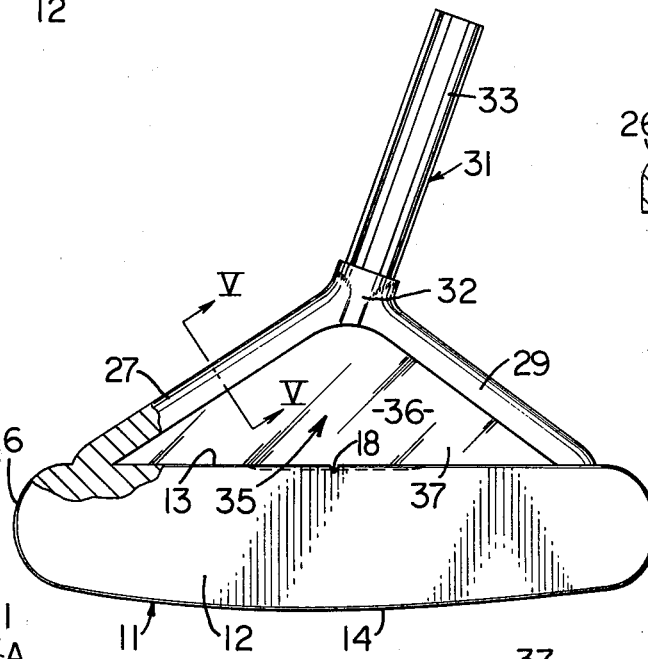
FIG. 3 is a front elevational view of the golf putter.
Figure 5:
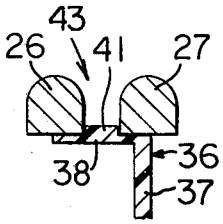
FIG. 5 is a sectional view taken along the line V—V of FIG. 3.
Figure 6:
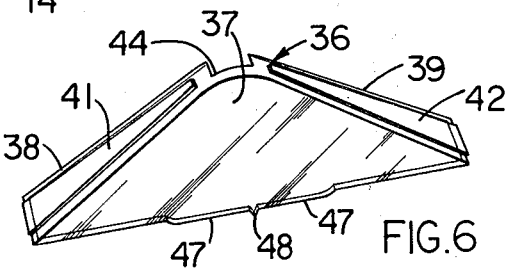
FIG. 6 is a perspective view of an insert element.
Figure 7:
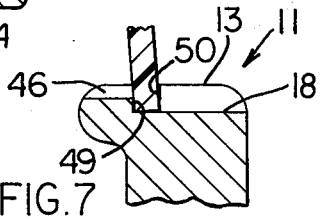
FIG. 7 is an enlarged fragmentary sectional view of the structure illustrated in the encircled portion "A" in FIG. 4.

Four prongs 26, 27, 28 and 29 are separately secured to the horizontally upper surface 13 adjacent the longitudinal ends 16 and 17. The four prongs are divided into two groups of two prongs. More specifically, one group of prongs 26 and 27 are secured to the horizontally extending surface 13 at a location which is between the sidewall 21 of the recess 19 and the longitudinal end 16 whereas the other group of prongs 28 and 29 are secured to the horizontally extending upper surface 13 at a location which is between the sidewall 22 and the longitudinal end 17. In this particular embodiment, the location where the prongs 26 and 27 are individually secured to the horizontal surface 13 are equally spaced from the theoretical central plane containing the longitudinal axis of the groove 18. Similarly, the prongs 28 and 29 are each secured to the surface 13 at a location which is equally spaced from the theoretical plane, which distance is equal to the spacing for the prongs 26 and 27. In this particular embodiment, the prongs 26, 27, 28 and 29 are each integrally formed with the elongated head 11 as illustrated by the partial section illustrated in the left corner of FIG. 3.

The prongs 26, 27, 28 and 29 each extend upwardly from the upper surface 13 of the elongated head 11 and terminate in an elongated support member 31. The elongated support member 31 has a hub portion 32 to which the upper ends of each of the prongs 26, 27, 28 and 29 are secured. The support member 31 also includes an elongated splined rod 33 which extends upwardly from the hub portion 32. An elongated shaft 34 of a golf club handle (illustrated in broken lines in FIG. 1) is generally hollow and is sleevably mounted over the splined rod 33 and is secured thereto. In this particular embodiment, the prongs 26, 27, 28 and 29 are integrally secured to the elongated support member 31. In fact, the entire golf putter head assembly 10 illustrated in the drawing is a monolithic unit.

Figure 2:
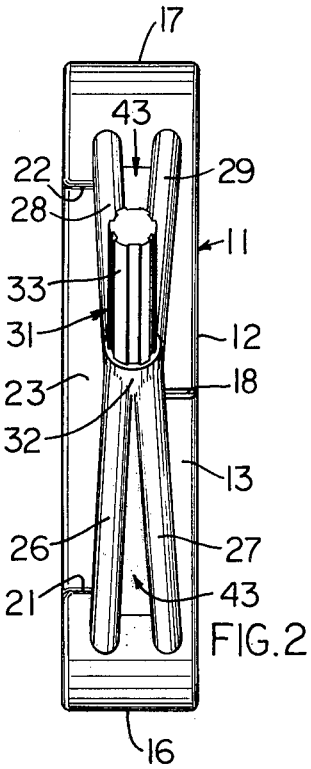
FIG. 2 is a top elevational view of the golf putter.
Figure 4:
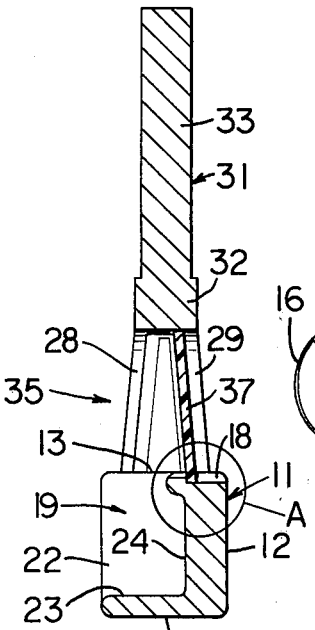
FIG. 4 is a sectional view taken along the line IV—IV of FIG. 1.

An insert 36 is mounted, as stated above in the generally triangular-shaped opening 35 defined by the prongs 26, 27, 28 and 29 and the upper surface 13 of the elongated head 11. In this particular embodiment, the insert 36 is a clear plastic member which is generally triangular in shape to conform with the triangular-shaped opening 35. The insert 36 has a generally vertical, planar surface 37 which is triangular in shape to precisely conform with the shape of the triangular-shaped opening 35. A pair of flanges 38 and 39 extend rearwardly from the vertical surface 37 and are inclined to the vertical so that the slope of the flanges 38 and 39 is equal to the slope of the respective prongs 26, 27, 28 and 29. Each flange 38, 39 has a triangular-shaped raised portion 41 and 42, respectively, thereon. The shape of the triangular portions 41 and 42 conform in dimension to the triangular-shaped opening 43 (FIG. 2) defined by the prongs 26, 27 and 28, 29 and the upper surface 13 of the elongated head 11. The triangular-shaped openings 43 are best illustrated in FIG. 2. That is, the prongs 26 and 27 converge upwardly from the surface 13 toward the hub 32. The flanges 38 and 39 are generally flexibly secured to the planar surface 37 so that the flanges can be flexed to permit the passage of the triangularly raised portions 41 and 42 past the inside surfaces of the prongs 26, 27, 28 and 29. When the triangularly-shaped portions 41 and 42 are positioned between the respective pairs of prongs 26, 27 and 28, 29, the resiliency of the flanges 38, 39 will cause the triangulary-shaped raised portions 41 and 42 to snap into position between the respective pairs of prongs 26, 27 and 28, 29. A notch 44 is provided at the apex of the triangularly-shaped insert 37 between the flanges 38 and 39 to facilitate an independent flexing of the flanges 38 and 39 relative to the vertical surface 37.

In addition, and in order to facilitate a connection of the insert 36 in the generally triangular-shaped opening 35, the upper surface 13 of the elongated head 11 has a laterally extending notch 46 along the rearward side thereof and opens outwardly along the rearward edge. The bottom of the elongated groove 18 extends partially into the notch 46 and terminates at a shoulder 49. The insert 36 has a rib 47 extending downwardly from the lower edge of the generally vertical, planar surface 37 with the centermost portion of the rib 47 having a downwardly extending tip 48 thereon. The tip 48 has a length which is compatible with the depth of the notch 18 which extends into the notch 46 in the upper surface 13 of the head 11. In addition, the width of the rib 47 is equal to the width of the notch 46. As a result, and when the insert 36 is inserted into the generally triangular-shaped opening 35, the rib 47 will be received in the notch 46 and the tip 48 will extend into the groove 18. Since the groove 18 does not open rearwardly of the upper surface 13 but, instead, terminates short of the rear edge at the shoulder 49, the tip 18 will prevent a rearward movement of the surface 37. The rib 47 will engage the front wall 50 of the notch 46 to prevent a forward movement of the surface 37. Thus, the insert will be securely positioned within the triangular-shaped opening 35.

As illustrated in FIG. 2, the hub 32 is positioned slightly rearwardly from the plane of the striking face 12 and above the center of mass of the head 11 so that the central groove 18 is readily visible by the golfer. As a result, the golfer will be able to align the movement of the putter head with the ball so that the ball will be struck closely adjacent the central plane of the golf putter.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property:

1. A golf putter, comprising:

an elongated head having an upright striking face and means defining a generally horizontally extending surface extending rearwardly from said striking face adjacent an upper edge thereof;

four prongs independently connected to said horizontally extending surface, said four prongs being grouped into two groups of two prongs, a first prong in each group being connected to said horizontally extending surface at a location spaced rearwardly from said upper edge, said first prongs being out of parallel alignment, a second prong in each group being connected to said horizontally extending surface at a location spaced further rearwardly from said first prongs, said second prongs being out of parallel alignment, said first prongs in said two groups at their place of attachment to said elongated head being equally spaced from a theoretical plane extending perpendicularly to said striking face and containing the center of said elongated head, said second prongs in said two groups at their place of attachment to said elongated head being equally spaced from said theoretical plane and from said first prongs, said two groups of prongs and said horizontally extending surface defining generally a first triangular-shaped opening therebetween; and support means spaced above said horizontally extending surface and including securement means for effecting a securement of said support means to a handle, said support means having a front-to-rear dimension less than the spacing between said front upright striking face and a rearmost portion on said elongated head and a side-to-side dimension less than the spacing between each prong at its place of connection to said horizontally extending surface and said theoretical plane, each of said four prongs extending between said horizontally extending surface and said support means converging upwardly therefrom and being connected at their upper ends to said support means, said support means being located at the apex of said first triangular-shaped opening, each of said prongs in each of said groups of prongs and said horizontally extending surface define generally second and third triangular-shaped openings therebetween, said support means being located at the apex of said second and third triangular-shaped openings.

2. A golf putter according to claim 1, wherein said location of the connection of said second prong in each group to said horizontally extending surface is spaced from said theoretical plane the same distance as said first prong in each group.

3. A golf putter according to claim 1, including a generally triangular-shaped insert having a size corresponding to the size of said first triangular-shaped opening and being received in said first triangular-shaped opening and securing means for securing said insert against movement relative to said prongs and said elongated head.

4. A golf putter according to claim 3, wherein said triangular-shaped insert has a generally vertically extending face extending upwardly from said horizontally extending surface adjacent said upper edge and a pair of flange means extending rearwardly from lateral edges of said vertically extending face, each of said flange means having cooperating means thereon for cooperating with at least one of said prongs in each of said groups to secure said triangular-shaped insert against movement relative to said prongs and said elongated head.

5. A golf putter according to claim 4, wherein said cooperating means on said flange means is a triangular-shaped protrusion adapted to be snugly received in said second and third openings between said first and second prongs in each of said groups.

6. A golf putter according to claim 1, wherein said four prongs have a uniform cross section over their entire length.

7. A golf putter according to claim 6, wherein said elongated head, said four prongs and said support means are a monolithic unit.

8. A golf putter, comprising:

an elongated head having an upright striking face and means defining a generally horizontally extending surface extending rearwardly from said striking face adjacent an upper edge thereof;

prong means independently connected to said horizontally extending surface, said prong means being connected to said horizontally extending surface at a location spaced rearwardly from said upper edge and being laterally spaced from a theoretical plane extending perpendicularly to said striking face and containing the center of said elongated head;

means defining a support spaced above said horizontally extending surface and adapted to be secured to a handle, each of said prong means extending between said horizontally extending surface and said support means and being connected at the upper ends to said support means to define a generally triangular-shaped opening therebetween;

generally triangularly-shaped insert means having a size corresponding to the size of said triangular-shaped opening and being received in said triangular-shaped opening; and securing means for securing said insert against movement relative to said prong means and said elongated head, said prong means providing the only force transmitting structure between said support means and said elongated head means.

9. A golf putter, comprising:

an elongated head having an upright striking face and means defining a generally horizontally extending surface extending rearwardly from said striking face adjacent an upper edge thereof;

four prongs independently connected to said horizontally extending surface, said four prongs being grouped into two groups of two prongs, a first prong in each group being connected to said horizontally extending surface at a location spaced rearwardly from said upper edge, said first prongs being out of parallel alignment, a second prong in each group being connected to said horizontally extending surface at a location spaced further rearwardly from said first prong, said second prongs being out of parallel alignment, said two groups of prongs and said horizontally extending surface defining generally a first triangular-shaped opening therebetween; and support means spaced above said horizontally extending surface and including securement means for effecting a securement of said support means to a handle, said support means having a front-to-rear dimension less than the spacing between said front upright striking face and a rearmost portion on said elongated head and a side-to-side dimension less less than the spacing between each prong and one-half the lateral spacing between said two groups of prongs at their place of connection to said horizontally extending surface, each of said four prongs extending between said horizontally extending surface and said support means converging upwardly therefrom and being connected at their upper ends to said support means, said support means being located at the apex of said first triangular-shaped opening, each of said prongs in each of said groups of prongs and said horizontally extending surface define generally second and third triangular-shaped openings therebetween, said support means being located at the apex of said second and third triangular-shaped openings.

* * * * *